US007587164B2

(12) United States Patent
Iwasaki

(10) Patent No.: US 7,587,164 B2
(45) Date of Patent: Sep. 8, 2009

(54) CLEANING DEVICE, IMAGE CARRIER UNIT AND IMAGE-FORMING APPARATUS

(75) Inventor: Jin Iwasaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/812,767

(22) Filed: Jun. 21, 2007

(65) Prior Publication Data

US 2008/0101834 A1 May 1, 2008

(30) Foreign Application Priority Data

Oct. 31, 2006 (JP) ..... P2006-297007

(51) Int. Cl.
*G03G 21/00* (2006.01)

(52) U.S. Cl. ..... 399/357

(58) Field of Classification Search ..... 399/349, 399/352, 353, 354, 357, 358, 123, 71
See application file for complete search history.

(56) References Cited

U.S. PATENT DOCUMENTS

| | | | | |
|---|---|---|---|---|
| 4,686,132 | A * | 8/1987 | Sumii et al. | 428/171 |
| 5,233,398 | A * | 8/1993 | Nimura et al. | 399/354 |
| 5,652,649 | A * | 7/1997 | Ikegawa et al. | 399/175 |
| 2005/0196181 | A1* | 9/2005 | Taguchi et al. | 399/12 |
| 2006/0093955 | A1* | 5/2006 | Ohshima et al. | 430/125 |

FOREIGN PATENT DOCUMENTS

| | | |
|---|---|---|
| JP | 62-67578 | 3/1987 |
| JP | 63-4569 | 1/1988 |
| JP | 01-170976 | 7/1989 |
| JP | 1-273083 | 10/1989 |
| JP | 09-034271 | 2/1997 |
| JP | 09-114342 | 5/1997 |
| JP | 2001-5360 | 1/2001 |
| JP | 2002-116592 | 4/2002 |
| JP | 2006-189502 | 7/2006 |

* cited by examiner

*Primary Examiner*—David M Gray
*Assistant Examiner*—Bryan P Ready
(74) *Attorney, Agent, or Firm*—Morgan, Lewis & Bockius LLP

(57) ABSTRACT

A cleaning device includes a first cleaning member that includes a surface layer formed by a cloth made of conductive fibers, contacts an image carrier holding an image and cleans the image carrier with a predetermined voltage applied to the first cleaning member; a second cleaning member that contacts the image carrier and cleans the image carrier with a predetermined voltage applied to the second cleaning member; a first collection member that contacts the first and second cleaning members and collects adhering substances from the first and second cleaning member with a predetermined voltage applied to the first collection member; and a second collection member that contacts the second cleaning member and collects adhering substances form the second cleaning member with a predetermined voltage applied to the second collection member.

17 Claims, 12 Drawing Sheets

FIG. 10

| HELD AMOUNT OF TONER (g/m2) | IMAGE DELETION | FILMING | CLEANING PERFORMANCE |
|---|---|---|---|
| 7 | OCCUR | NOT OCCUR | EXCELLENT |
| 8 | OCCUR | NOT OCCUR | EXCELLENT |
| 9 | OCCUR | NOT OCCUR | EXCELLENT |
| 20 | OCCUR | NOT OCCUR | EXCELLENT |
| 30 | NOT OCCUR | NOT OCCUR | EXCELLENT |
| 40 | NOT OCCUR | NOT OCCUR | EXCELLENT |
| 65 | NOT OCCUR | NOT OCCUR | EXCELLENT |
| 90 | NOT OCCUR | NOT OCCUR | EXCELLENT |
| 108 | NOT OCCUR | NOT OCCUR | EXCELLENT |
| 132 | NOT OCCUR | NOT OCCUR | EXCELLENT |
| 150 | NOT OCCUR | NOT OCCUR | EXCELLENT |
| 154 | NOT OCCUR | NOT OCCUR | POOR |
| 163 | NOT OCCUR | NOT OCCUR | POOR |
| 170 | NOT OCCUR | NOT OCCUR | VERY POOR |
| 186 | NOT OCCUR | NOT OCCUR | VERY POOR |

CLEANING DEVICE, IMAGE CARRIER UNIT AND IMAGE-FORMING APPARATUS

CROSS-REFERENCE TO RELATED APPLICATIONS

This application is based on and claims priority under 35 USC 119 from Japanese Patent Application No. 2006-297007 filed on Oct. 31, 2006.

BACKGROUND

Technical Field

The present invention relates to a cleaning device to be used in an image-forming apparatus using the electrophotographic system, and an image carrier unit and image-forming apparatus which use the device.

SUMMARY

According to an aspect of the invention, there is provide a cleaning device including a first cleaning member that includes a surface layer formed by a cloth made of conductive fibers, contacts an image carrier holding an image and cleans the image carrier with a predetermined voltage applied to the first cleaning member; a second cleaning member that contacts the image carrier and cleans the image carrier with a predetermined voltage applied to the second cleaning member; a first collection member that contacts the first and second cleaning members and collects adhering substances from the first and second cleaning member with a predetermined voltage applied to the first collection member; and a second collection member that contacts the second cleaning member and collects adhering substances form the second cleaning member with a predetermined voltage applied to the second collection member.

BRIEF DESCRIPTION OF THE DRAWINGS

Exemplary embodiment(s) of the present invention will be described in detail based on the following figures, wherein:

FIG. 10 is a view for evaluating relationships between the held amount of toner held in the fiber layer of the first cleaning roll and the occurrence or non-occurrence of image deletion due to discharge products of the surface of the photosensitive drum, etc;

DETAILED DESCRIPTION

Hereinafter, an exemplary embodiment of the invention will be described in detail with reference to the accompanying drawings.

Figure 1:
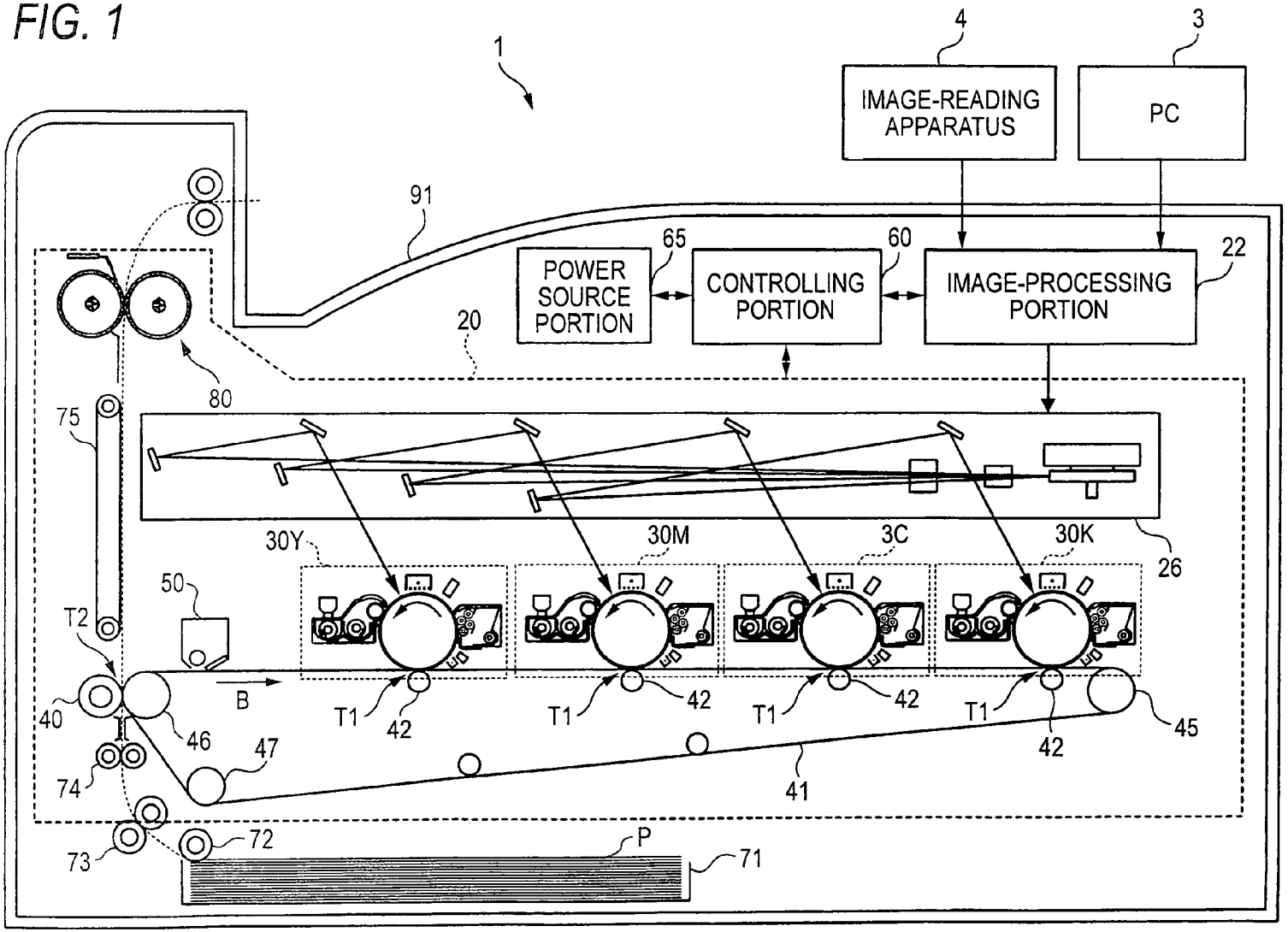
FIG. 1 is a view showing the configuration of a color printer that is an example of an image-forming apparatus to which the invention is applied.
Figure 2:
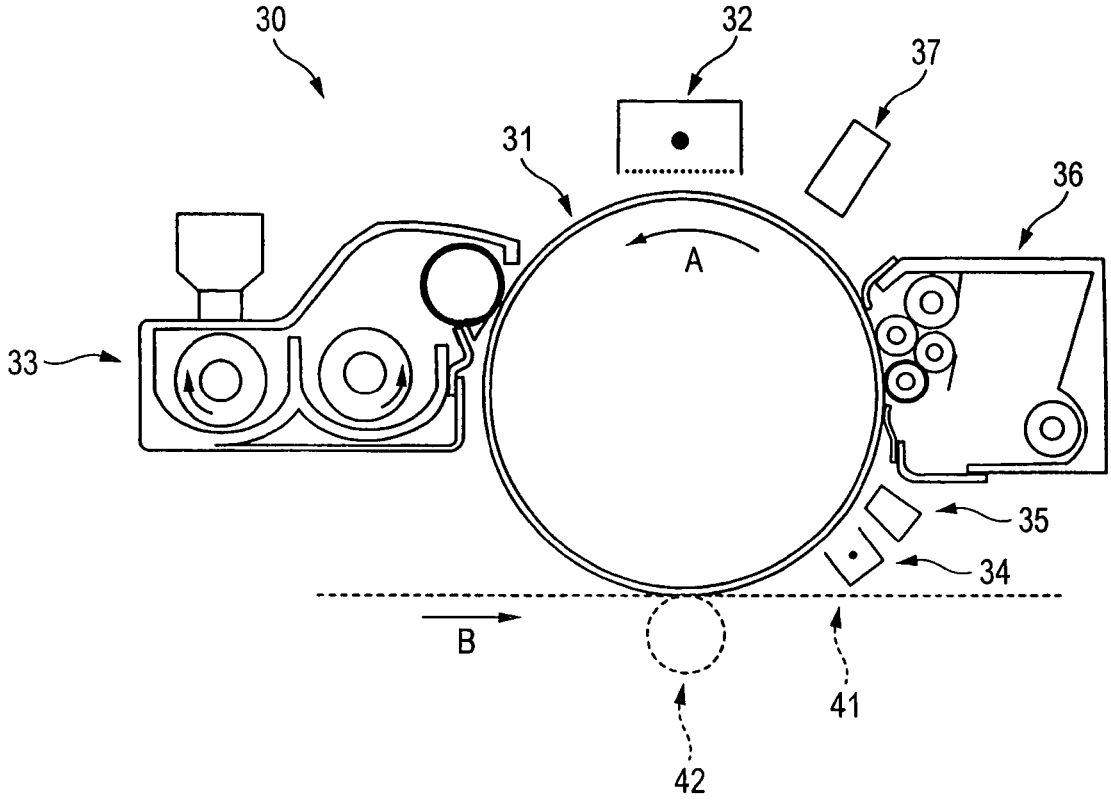
FIG. 2 is a view showing the configuration of an image-forming unit.

FIG. 1 is a view showing the configuration of a color printer 1 as an example of an image-forming apparatus to which the exemplary embodiment is applied. FIG. 2 is a view showing the configuration of an image-forming unit.

The color printer 1 shown in FIG. 1 is configured by: an image-forming process portion 20 which is configured as a so-called tandem type one, and which performs image formation correspondingly with image data of respective colors; an image-processing portion 22 which is connected to, for example, a personal computer (PC) 3 and an image-reading apparatus 4 such as a scanner, and which applies a predetermined image process on the image data received therefrom; a controlling portion 60 which controls various portions constituting the color printer 1; and a power source portion 65 which supplies a power to various portions of the color printer 1.

The image-forming process portion 20 includes four image-forming units 30Y, 30M, 30C, 30K (hereinafter, generally referred to as "image-forming units 30") which are arranged in a parallel manner at constant intervals.

As shown in FIG. 2, each of the image-forming units 30 includes: a photosensitive drum 31 serving as an image carrier on which an electrostatic latent image is formed while the image carrier rotates in the direction of the arrow A, and a toner image is then formed; a charger 32 which uniformly charges the surface of the photosensitive drum 31 to a predetermined potential, and which is configured by, for example, a scorotron; a developer 33 serving as a developing portion which toner-develops the electrostatic latent image formed on the photosensitive drum 31, to form the image as a toner image; a pre-cleaning charger 34 which, after the toner image is transferred onto an intermediate transfer belt 41 by a primary transferring portion T1, causes a toner and the like remaining on the surface of the photosensitive drum 31 to have the same charge polarity (for example, a minus polarity); a destaticizing lamp 35 which removes surface charges from the photosensitive drum 31 after the transfer; a drum cleaner 36 which is an example of a cleaning device for cleaning a toner and the like remaining on the surface of the photosensitive drum 31 after the transfer; and a pre-charge lamp 37 which erases latent image hysteresis produced before charging.

The image-forming units 30Y, 30M, 30C, 30K are configured in a substantially same manner except the toner stored in the developer 33.

The unit configuration of the image-forming process portion 20 is not restricted to the image-forming units 30. Alternatively, an image carrier unit may be configured by integrating the photosensitive drum 31 with the drum cleaner 36, and the portion may be configured so as to be replaceable in the unit of the image carrier unit. Such image carrier units may constitute the image-forming units 30.

The image-forming process portion 20 further includes: a laser exposing device 26 which exposes the photosensitive drum 31 disposed in each of the image-forming units 30; the intermediate transfer belt 41 serving as a transfer member onto which color toner images formed on the photosensitive drums 31 of the image-forming units 30 are multiple-transferred; primary transfer rolls 42 serving as a transferring portion which causes the color toner images formed by the image-forming units 30 to be sequentially transferred (primarily transferred) onto the intermediate transfer belt 41 in the primary transferring portions T1; a secondary transfer roll 40 which causes the superimposed toner image transferred onto the intermediate transfer belt 41 to be collectively transferred (secondarily transferred) in a secondary transferring portion T2 onto a recording sheet P; and a fixing device 80 which fixes the secondarily transferred toner image onto the recording sheet P.

The intermediate transfer belt 41 is stretched in a path circulating through the image-forming units 30Y, 30M, 30C, 30K by: a driving roll 45; a backup roll 46 which supports the intermediate transfer belt 41 in the secondary transferring portion T2 from the back side; an idle roll 47 which supports the intermediate transfer belt 41; and the like, and. circularly moved in the direction of the arrow B in FIG. 1 by rotation of the driving roll 45 caused by rotating unit (not shown). The intermediate transfer belt 41 includes a belt cleaner 50 which is disposed in contact therewith.

The color printer further includes a sheet tray 71 which stores recording sheets P serving as recording media, and a recording-sheet conveying mechanism which conveys the recording sheets P stored in the sheet tray 71.

The recording-sheet conveying mechanism is configured by: a pickup roll 72 which takes out the recording sheet P from the sheet tray 71; a conveyor roll 73 which conveys the recording sheet P to the secondary transferring portion T2; a register roll 74 which defines the position of the recording sheet P; a conveyor belt 75 which conveys the recording sheet from the secondary transferring portion T2 to the fixing device 80; and the like.

In the color printer 1 of the exemplary embodiment, an image-forming operation is implemented in the image-forming process portion 20 under the control of the controlling portion 60. Specifically, image data of respective color components supplied from the personal computer 3 or the image-reading apparatus 4 are subjected to a predetermined imaging process by the image-processing portion 22, and then supplied to the laser exposing device 26. The laser exposing device 26 scan-exposes the photosensitive drums 31 of the image-forming units 30. In the image-forming unit 30Y for yellow (Y), for example, the photosensitive drum 31 which is uniformly charged to the predetermined potential by the charger 32 is scan-exposed by a laser beam which is modulated by the laser exposing device 26 on the basis of image data of the yellow (Y) component, whereby an electrostatic latent image of the yellow (Y) component is formed on the photosensitive drum 31. The formed electrostatic latent image is developed by the developer 33, so that a toner image of yellow (Y) is formed on the photosensitive drum 31. Also in the image-forming units 30M, 30C, 30K, similarly, toner images of magenta (M), cyan (C), and black (K) are formed. In the exemplary embodiment, the toner is charged to the minus polarity by the developer 33.

The color toner images formed in the respective image-forming units 30 are sequentially electrostatically transferred by the primary transfer rolls 42 onto the intermediate transfer belt 41 which is circularly moved in the direction of the arrow B in FIG. 1, whereby a toner image (superimposed toner image) in which the color toner images are superimposed is formed on the intermediate transfer belt 41. In accordance with the movement of the intermediate transfer belt 41, the superimposed toner image is conveyed to the secondary transferring portion T2 in which the secondary transfer roll 40 and the backup roll 46 are disposed. On the other hand, the recording sheets P are taken out from the sheet tray 71 by the pickup roll 72, and conveyed one by one to the position of the register roll 74 by the conveyor roll 73.

When the superimposed toner image is conveyed to the secondary transferring portion T2, the recording sheet P is supplied from the register roll 74 to the secondary transferring portion T2 in timing with the conveyance of the toner image to the secondary transferring portion T2. In the secondary transferring portion T2, the superimposed toner image is collectively transferred (secondarily transferred) onto the recording sheet P by the function of the transfer electric field formed between the secondary transfer roll 40 and the backup roll 46.

Then, the recording sheet P onto which the superimposed toner image is transferred is separated from the intermediate transfer belt 41, and conveyed to the fixing device 80 while being attracted and supported by the conveyor belt 75. The unfixed toner image on the recording sheet P which is conveyed to the fixing device 80 is subjected to the fixing process by the fixing device 80 by means of heat and pressure to be fixed onto the recording sheet P. The recording sheet P on which the fixed image is formed is conveyed to a discharged sheet stack portion 91 which is disposed in a discharge portion of the image-forming apparatus. On the other hand, a toner (post-transfer residual toner) adheres to the intermediate transfer belt 41 after the secondary transfer is removed by the belt cleaner 50 butting against the intermediate transfer belt 41, so that the unit is prepared for the next image-forming cycle.

On the other hand, in the surface of the photosensitive drum 31 after the transferring process is performed in the primary transferring portion T1, the charge polarities of the toner remaining on the surface of the photosensitive drum 31, a toner which is retransferred from the intermediate transfer belt 41, and the like are uniformly set to the minus polarity by the pre-cleaning charger 34. The surface charges of the photosensitive drum 31 after the transfer are reduced to about 0 V by the destaticizing lamp 35. The toner and the like remaining on the surface of the photosensitive drum 31 are removed by the drum cleaner 36. The whole surface of the photosensitive drum 31 which is passed through the drum cleaner 36 is exposed by the pre-charge lamp 37, whereby a process of erasing the latent image hysteresis produced in the previous image-forming cycle is performed before the charging process conducted by the charger 32.

In the color printer 1, the above-described image-forming cycle is performed for each image formation.

Next, the drum cleaner 36 which is a characteristic of the exemplary embodiment will be described.

Figure 3:
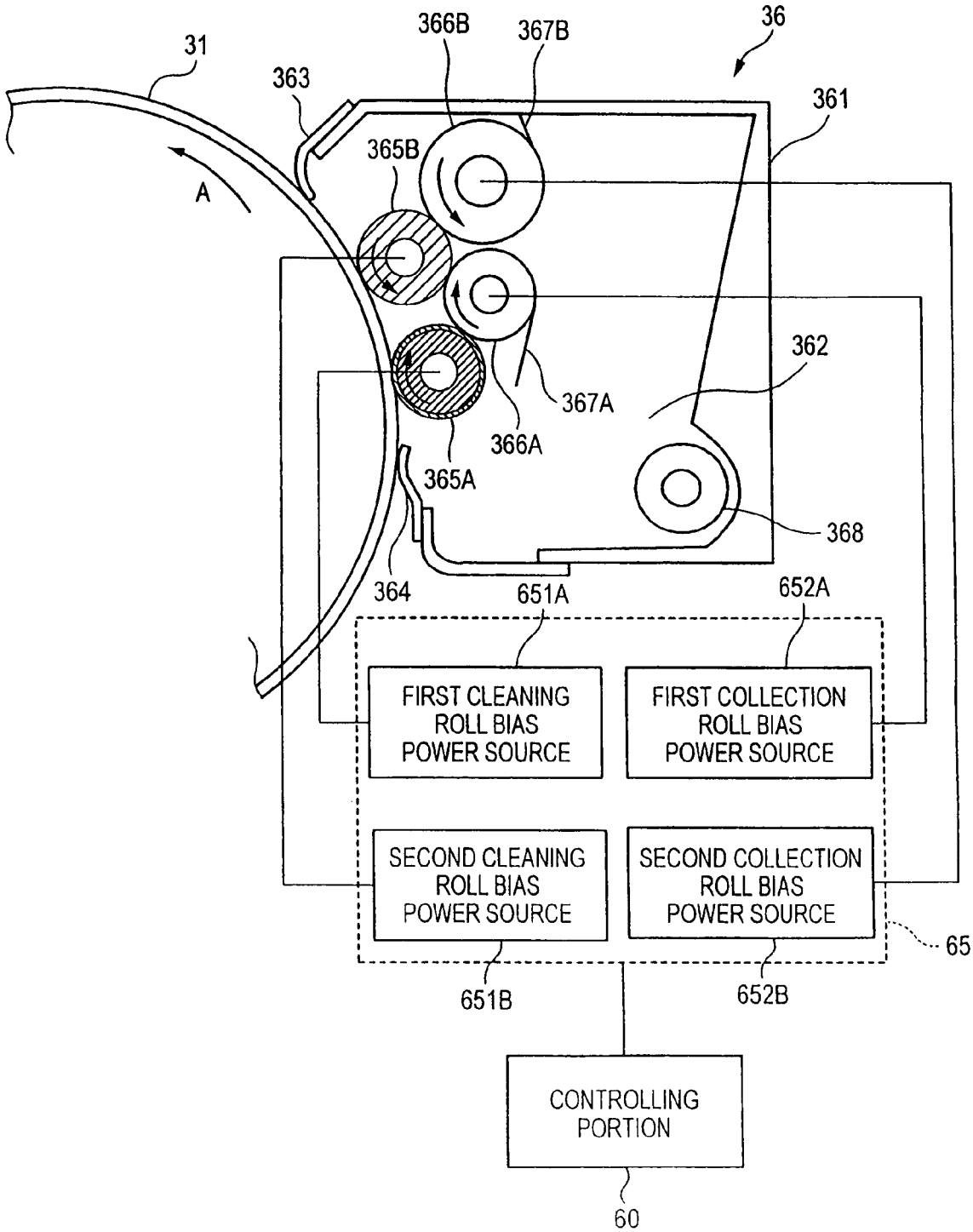
FIG. 3 is a view showing the configuration of a drum cleaner in the exemplary embodiment.
Figure 4:
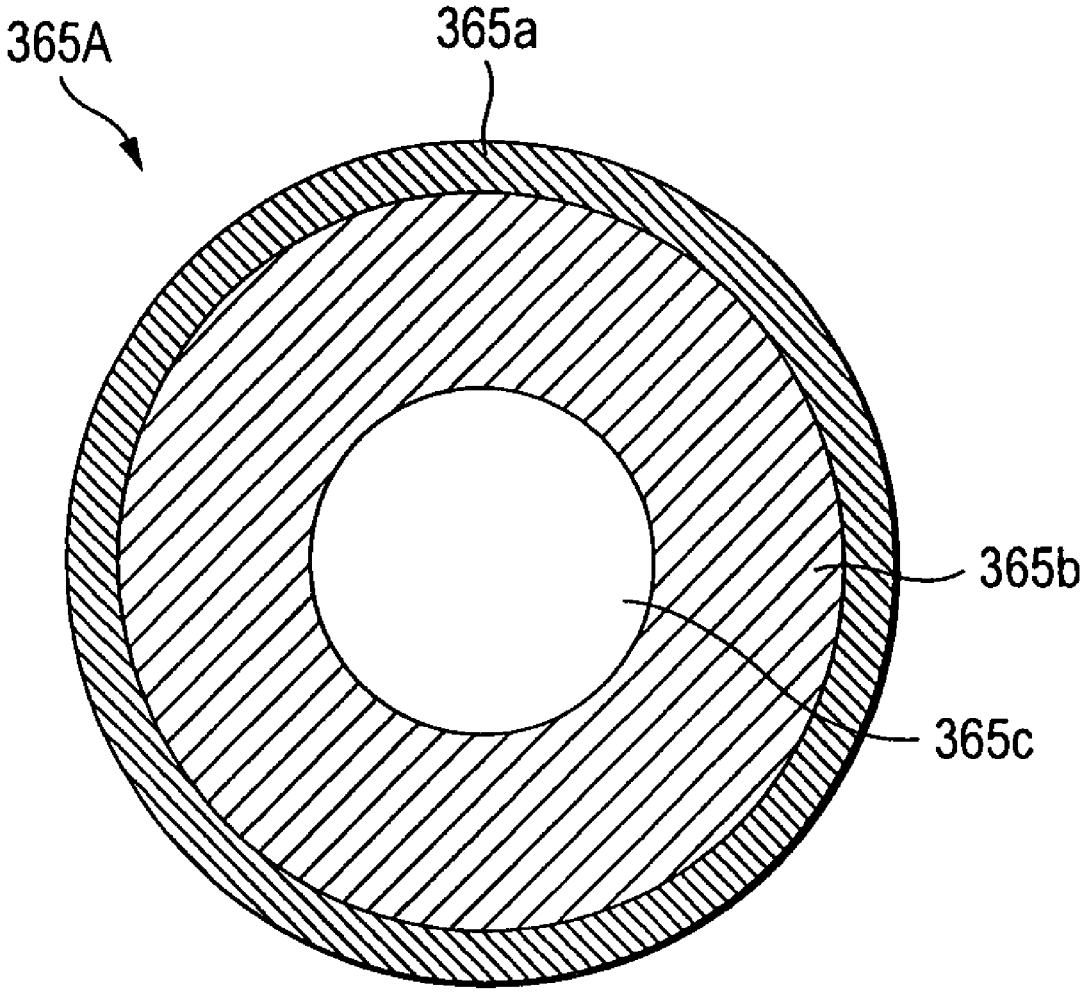
FIG. 4 is a sectional view of a first cleaning roll.

FIG. 3 is a view showing the configuration of the drum cleaner 36 of the exemplary embodiment, and FIG. 4 is a sectional view of a first cleaning roll 365A of the cleaner.

Inside a housing 361, the drum cleaner 36 includes two cleaning rolls (the first cleaning roll 365A serving as a first cleaning member, and a second cleaning roll 365B serving as a second cleaning member) which remove a toner adhering to the photosensitive drum 31. The drum cleaner further includes: a first collection roll 336A serving as a first collection member which collects a toner removed by the cleaning rolls 365A, 365B; and a first scraper 367A which scrapes off a toner transferred to the surface of the first collection roll 366A. The drum cleaner further includes: a second collection roll 366B serving as a second collection member which collects a toner removed by the second cleaning roll 365B; and a second scraper 367B which scrapes off a toner transferred to the surface of the second collection roll 366B.

Hereinafter, in the case where it is not required to describe particularly separately the cleaning rolls, the first cleaning roll 365A and the second cleaning roll 365B are referred to simply as the cleaning rolls 365A, 365B. Furthermore, the first collection roll 366A and the second collection roll 366B are referred to as the collection rolls 366A, 366B, and the first scraper 367A and the second scraper 367B are referred to as the scrapers 367A, 367B.

The first cleaning roll 365A and the second cleaning roll 365B are disposed in contact with the photosensitive drum 31. The second cleaning roll 365B is positioned on the downstream side of the first cleaning roll 365A in the moving direction of the peripheral surface due to the rotation of the photosensitive drum 31.

The first collection roll 366A is placed between the first cleaning roll 365A and the second cleaning roll 365B so as to be in contact with both the cleaning rolls. According to the configuration, the first collection roll 366A can collect a toner from both the first cleaning roll 365A and the second cleaning roll 365B.

The second collection roll 366B is placed in contact with only the second cleaning roll 365B. According to the configuration, the second collection roll 366B collects a toner from only the second cleaning roll 365B.

To the first cleaning roll 365A, a predetermined bias voltage is supplied from a first cleaning roll bias power source 651A disposed in the power source portion 65.

To the second cleaning roll 365B, a predetermined bias voltage is supplied from a second cleaning roll bias power source 651B disposed in the power source portion 65.

To the first collection roll 366A, a predetermined bias voltage is supplied from a first collection roll bias power source 652A disposed in the power source portion 65.

To the second collection roll 366B, a predetermined bias voltage is supplied from a second collection roll bias power source 652B disposed in the power source portion 65.

The cleaning rolls 365A, 365B and the collection rolls 366A, 366B are rotated by the rotating mechanism which is not shown.

The housing 361 forms a toner storing portion 362 which stores a collected toner, and includes: downstream and upstream seals 363, 364 which close gaps between the hosing and the photosensitive drum 31; and a conveyor screw 368 which discharges the toner stored in the toner storing portion 362 to a collection box which is not shown, and which is placed outside the image-forming units 30.

The power source portion 65 is controlled by the controlling portion 60 of the color printer 1 (see FIG. 1). Namely, the bias voltages applied to the cleaning rolls 365A, 365B and the collection rolls 366A, 366B are controlled by the controlling portion 60, and also the rotations of the cleaning rolls 365A, 365B and the collection rolls 366A, 366B are controlled by the controlling portion 60.

Hereinafter, the portions of the drum cleaner 36 will be described in detail.

The first cleaning roll 365A is a roll which is rotatably supported on the housing 361, and which has a predetermined outer diameter. As shown in FIG. 4, the roll is configured by forming an elastic layer 365*b* having a predetermined thickness around a shaft 365*c* having a predetermined diameter, and a fiber layer 365*a* serving as a surface layer having a thickness of, for example, 900 μm so as to cover the surface of the elastic layer 365*b*.

The shaft 365*c* is made of a metal such as iron or SUS. The elastic layer 365*b* is formed by, for example, sponge-like foamed polyurethane with which a conductive agent such as carbon black is mixed so as to be adjusted to have a predetermined resistance. In the exemplary embodiment, foamed polyurethane is used. Alternatively, a rubber material such as NBR, SBR, or EPDM may be adequately used.

The fiber layer 365*a* is configured by, for example, a cloth-like member into which conductive fibers are knitted, that into which conductive fibers are woven, or a nonwoven cloth which is configured by conductive fibers. As the conductive fibers, for example, divided fibers of conductive nylon yarns (manufactured by KB SEIREN, LTD.) in which carbon black is dispersed, and which have a thickness of 0.5 deniers (248 T/450 F) are used. When very thin conductive fibers are used in this way, the surface area of the fiber layer 365*a* is increased, so that a large amount of toner can be held, and the cleaning performance can be enhanced. In this case, from the viewpoints of the toner holding property and the cleaning performance, conductive fibers having a thickness of 2 deniers (a diameter of about 15 μm) or less, preferably 1 denier (a diameter of about 11 μm) or less are suitably used.

As a nonwoven cloth, for example, a dry nonwoven cloth, a sponge band, and a wet nonwoven cloth are known. In the exemplary embodiment, a dry nonwoven cloth can be used. Specifically, a dry nonwoven cloth is formed by a process in which fibers of a length of several cm are formed into a thin sheet-like shape by a card or an air-random machine and several such sheets are stacked as required. Bonding of fibers is realized by twining the fibers by using a water jet.

As described above, in the first cleaning roll 365A, the fiber layer 365*a* made of soft conductive fibers is placed in the surface, and the elastic layer 365*b* is formed under the fiber layer 365*a*, whereby the sliding contact force to the surface of the photosensitive drum 31 is reduced.

The first cleaning roll 365A is placed so as to butt against the photosensitive drum 31 along the axial direction, and configured so that, in the butted portion, the roll is rotated in the opposite direction (a clockwise direction in FIG. 3) from the photosensitive drum 31. In this case, the rotation speed (peripheral speed) of the first cleaning roll 365A is set to be about 0.9 times the peripheral speed of the photosensitive drum 31. Namely, the first cleaning roll 365A slidingly moves with respect to the peripheral surface of the photosensitive drum 31. The rotation direction and speed can be set in accordance with the kinds of the photosensitive drum 31 and the toner, and the like.

The second cleaning roll 365B is a roll which is rotatably supported on the housing 361, and which has a predetermined outer diameter, or specifically a brush roll in which a soft conductive brush is disposed around a metal shaft having a predetermined diameter. The conductive brush is made of, for example, conductive nylon yarns in which carbon black is dispersed. As the conductive yarn, the same yarn as the conductive yarn constituting the surface of the first cleaning roll 365A can be used. However, the thickness, density, and length of the brush are adequately determined in consideration of the hardness of the photosensitive drum 31, the compatibility with the toner, and the like.

The second cleaning roll 365B is placed so as to be in contact with the photosensitive drum 31 along the axial direction, and configured so that, in the contacted portion, the roll is rotated in the same direction (a counterclockwise direction in FIG. 3) as the photosensitive drum 31.

The rotation direction and speed can be set in accordance with the kinds of the photosensitive drum 31 and the toner, and the like.

The second cleaning roll 365B is not restricted to such a brush roll, and may be a roll in which the surface layer is formed as a fiber layer in the same manner as the first cleaning roll 365A. The first roll has a function of removing discharge products. Therefore, the cleaning parameters (for example, the contact pressure) of the second roll can be set to be lower than those of a conventional cleaning roll, and are advantageous in the viewpoints of a scratch, filming, and abrasion of the photosensitive member. However, they are adequately determined in accordance with the hardness of the photosensitive member, the kind of the toner, and the like.

The collection rolls 366A, 366B are rolls which are rotatably supported on the housing 361, and which have a predetermined outer diameter. The rolls are formed by a phenol resin in which carbon black is dispersed to adjust the resistance. Alternatively, a metal such as an aluminum alloy or a stainless steel alloy may be used. In order to allow the scrapers 367A, 367B to smoothly slidingly move, a member in which a film of, for example, a fluorine resin such as Teflon (registered trademark) is formed may be used. However, the configuration is not restricted to the above-described ones, and may be suitably selected in accordance with the system.

As described above, the first collection roll 366A is placed so as to butt against both the first cleaning roll 365A and the second cleaning roll 365B along the axial direction, and configured so as to rotate in the same direction as the first cleaning roll 365A so that their moving directions are opposite to each other in the butted portion with respect to the first cleaning roll 365A. The second collection roll 366B is placed so as to butt against the second cleaning roll 365B along the axial direction, and configured so as to rotate in the same direction as the second cleaning roll 365B so that their moving directions are opposite to each other in the butted portion. The rotation direction and speed can be set in accordance with the efficiency of collecting a toner from the cleaning rolls 365A, 365B, and the like.

The scrapers 367A, 367B are plate-like members which are made of iron, a stainless steel alloy, or the like, and butted against the collection rolls 366A, 366B so as to be opposed thereto in the rotation direction, along the axial direction of the collection rolls 366A, 366B. The toner transferred to the collection rolls 366A, 366B is scraped off, and then stored in the toner storing portion 362.

The toner which is stored in the toner storing portion 362 in this way is discharged by the conveyor screw 368 into the collection box (not shown) which is placed outside the image-forming units 30.

Figure 5:
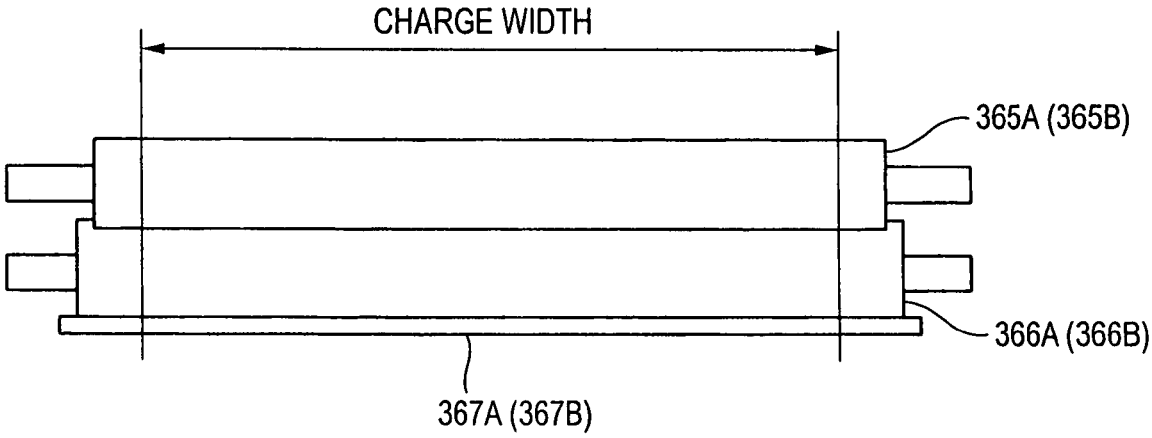
FIG. 5 is a diagram illustrating relationships among axial lengths of cleaning rolls, collection rolls, and scrapers.

The axial lengths of the cleaning rolls 365A, 365B, the collection rolls 366A, 366B, and the scrapers 367A, 367B are set to have the following relationships. FIG. 5 is a diagram illustrating the length relationships.

Namely, the cleaning rolls 365A, 365B are set to be laterally longer by a predetermined margin than the charge width of the photosensitive drum 31. The collection rolls 366A, 366B are set to be laterally longer by a predetermined margin than the lengths of the cleaning rolls 365A, 365B. The scrapers 367A, 367B are set to be laterally longer by a predetermined margin than the lengths of the collection rolls 366A, 366B.

The collection rolls 366A, 366B and the scrapers 367A, 367B are configured so as to have the following positional relationships.

As shown in FIG. 3, one (the first collection roll 366A) of the collection rolls 366A, 366B is not positioned under (in the toner drop path of) the position where the scraper 367B removes a toner and the like from the other collection roll (the second collection roll 366B) situated on the upper side. In the configuration of FIG. 3, the first collection roll 366A and the second collection roll 366B are placed so as to vertically overlap with each other, but the diameter of the second collection roll 366B is set to be larger, whereby the first collection roll 366A is not positioned in the toner drop path.

Figure 6:
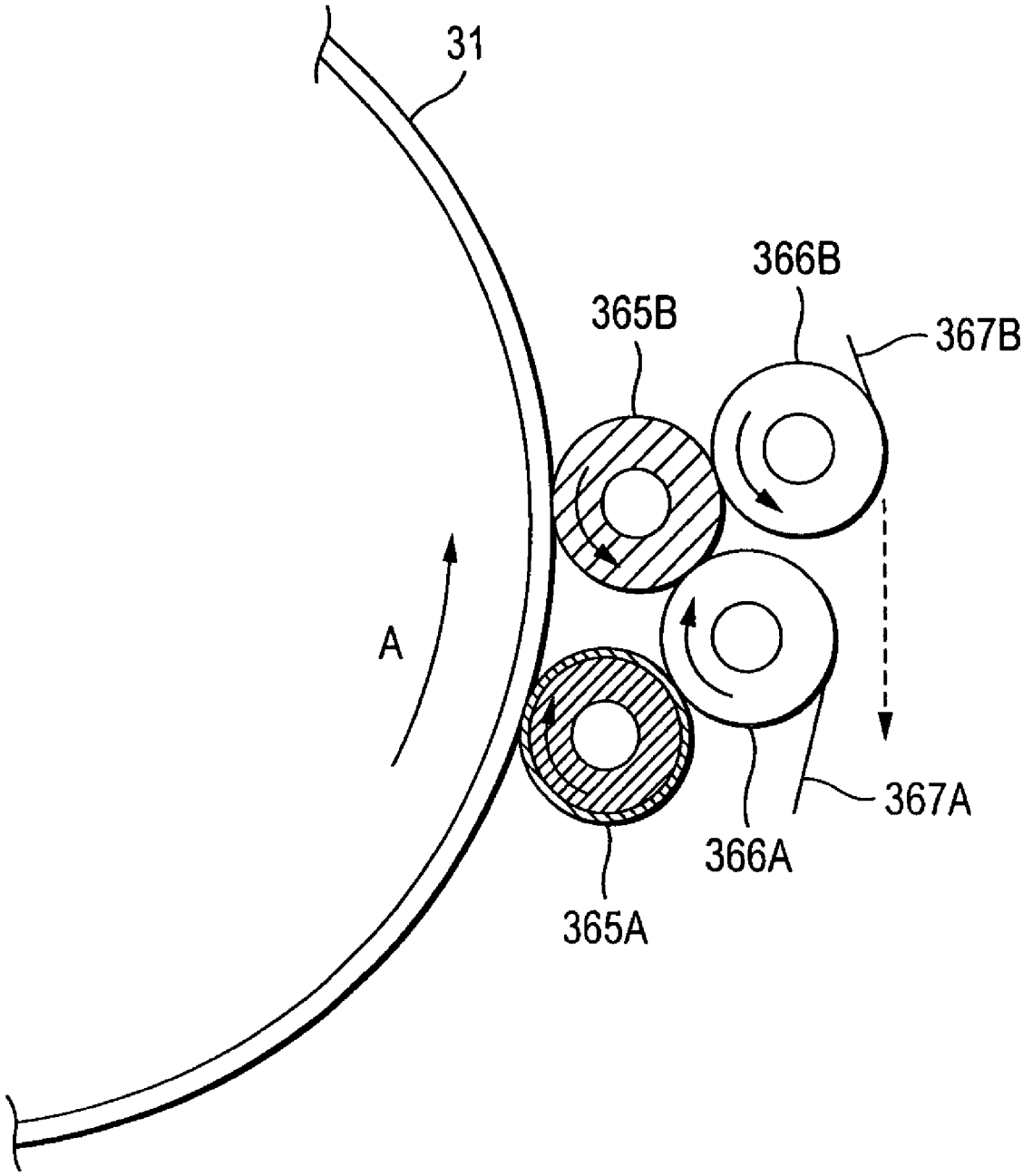
FIG. 6 is a view of a configuration example in which the collection rolls are placed so that a first collection roll is not positioned in a toner drop path.

FIG. 6 is a view of a configuration example in which the collection rolls 366A, 366B are placed so that the first collection roll 366A is not positioned in the toner drop path.

In the placement configuration of FIG. 6, the collection rolls 366A, 366B having a substantially same diameter are used, and, in positional relationships including also the cleaning rolls 365A, 365B, the first collection roll 366A is set so as not to be positioned under (in the toner drop path or) the position where the scraper 367B scrapes off a toner from the second collection roll 366B situated on the upper side.

Next, the function and the like of the thus configured drum cleaner 36 will be described. The reference numerals of the components in the description are identical with those of above-described FIGS. 1 to 4.

The drum cleaner 36 in which the predetermined bias voltages are applied to the rolls by the power source portion 65 (power sources) under the control of the controlling portion 60 functions as described below to clean the photosensitive surface of the photosensitive drum 31.

Here, in the surface of the photosensitive drum 31 to be cleaned by the drum cleaner 36, toners charged to both the polarities or the minus and plus polarities exist.

Namely, most of toners which remain on the surface of the photosensitive drum 31 maintain the minus polarity which is charged by the developer 33, and are uniformly set to the minus polarity by the charging function of the pre-cleaning charger 34. By contrast, toners which, when a toner image on the photosensitive drum 31 is electrostatically transferred in the primary transferring portion T1 onto the intermediate transfer belt 41, are charged to the plus polarity by the transfer voltage applied from the primary transfer roll 42, and which remain on the surface of the photosensitive drum 31 while maintaining the plus polarity in spite of the charging function of the pre-cleaning charger 34 exist in no small amount (for example, about 10 to 20%).

In this configuration, the first cleaning roll 365A and the second cleaning roll 365B remove toners charged to both the polarities from the photosensitive drum 31. The first cleaning roll 365A holds a predetermined amount of toner, and removes filming, discharge products, and the like from the surface of the photosensitive drum 31.

During the cleaning operation, the following bias voltages are applied to the first cleaning roll 365A, the second cleaning roll 365B, the first collection roll 366A, and the second collection roll 366B, respectively. In the bias voltages, different DC voltages respectively for the rolls 365A, 365B, 366A, 366B are superimposed on an AC voltage of the same voltage and phase. According to the configuration, the AC voltages are shifted by the corresponding DC voltage.

Namely, the voltage of the second cleaning roll 365B is set so as to be changed to the plus polarity and the minus polarity in order that it can electrostatically attract and hold both the minus-charged toner and the plus-charged toner.

The voltage of the first cleaning roll 365A is set to be higher by a predetermined value with respect to that of the second cleaning roll 365B. The voltage of the first collection roll 366A is set to be higher by a predetermined value than that of the first cleaning roll 365A.

The voltage of the second collection roll 366B is set to be lower by a predetermined value with respect to that of the second cleaning roll 365B. The voltage difference is set to be large (the discharge inception voltage or less) as far as possible in the range where no discharge is produced. However, there is a case where a phenomenon that charges are injected from a cleaning roll to a toner prominently occurs depending on the kinds of the toner and an external additive, the environment, and the like. Therefore, the voltages are adequately determined in consideration of also the phenomenon.

Figure 7:
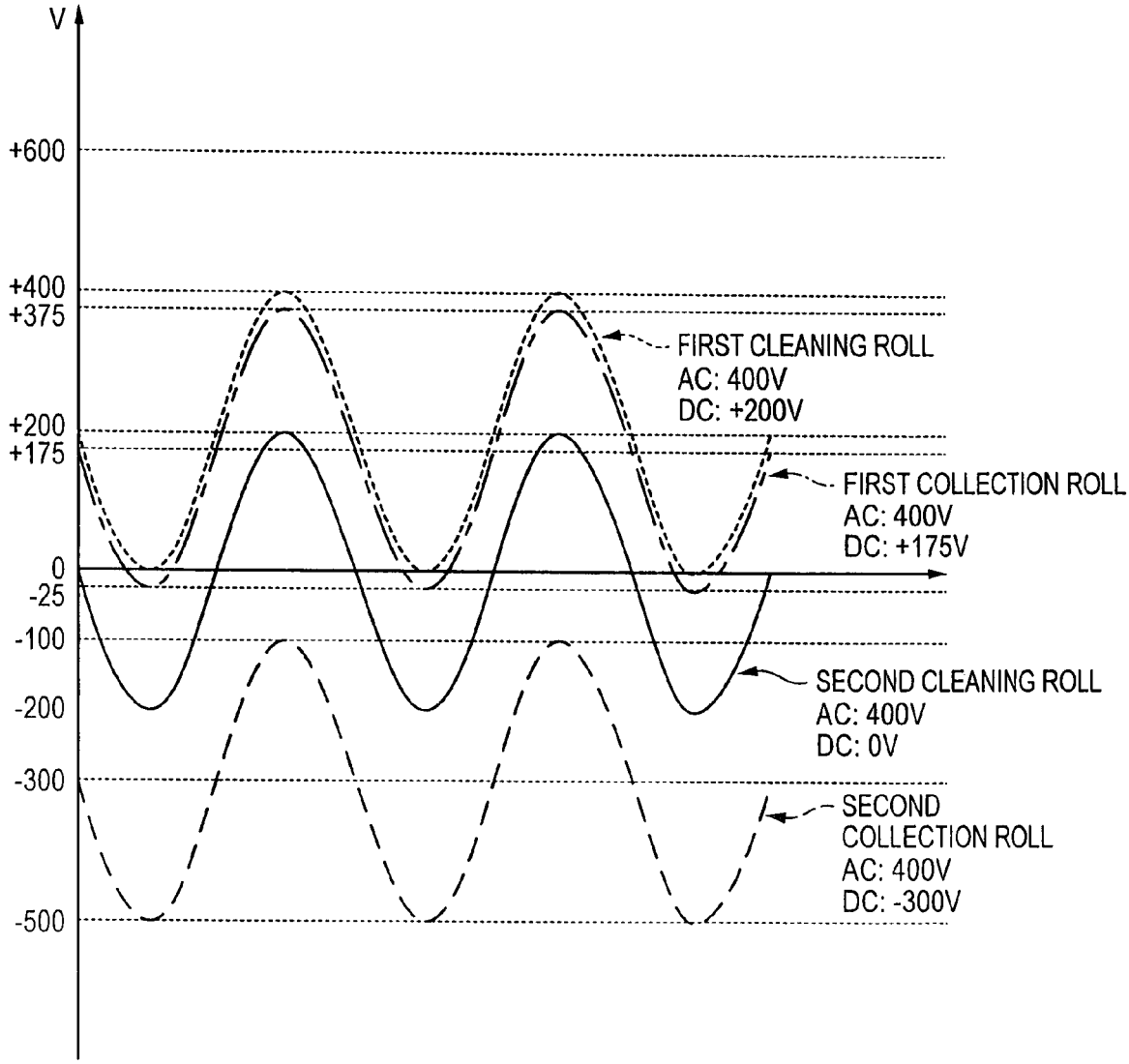
FIG. 7 is a view showing an example of bias voltages applied to the rolls of the drum cleaner.

FIG. 7 is a view showing an example of the bias voltages. In this example, the surface potential of the photosensitive drum 31 is set to 0 V.

A peak-to-peak AC voltage of 400 V and a DC voltage of +200 V are applied to the first cleaning roll 365A. Therefore, the first cleaning roll 365A always maintains the potential of 0 V or higher and the plus polarity.

Only a peak-to-peak AC voltage of 400 V (i.e., a DC voltage of +0 V) is applied to the second cleaning roll 365B. Therefore, the second cleaning roll 365B alternatingly repeats plus and minus potentials.

A peak-to-peak AC voltage of 400 V and a DC voltage of +175 V are applied to the first collection roll 366A which collects a toner from the first cleaning roll 365A and the second cleaning roll 365B. In the first collection roll 366A, therefore, a potential difference of −25 V is always produced with respect to the first cleaning roll 365A, and a potential difference of +175 V is always produced with respect to the second cleaning roll 365B.

A peak-to-peak AC voltage of 400 V and a DC voltage of −300 V are applied to the second collection roll 366B which collects a toner from the second cleaning roll 365B. In the second collection roll 366B, therefore, a potential difference of −300 V is always produced with respect to the second cleaning roll 365B.

The frequency of the applied AC voltage is 3.2 kHz. However, the frequency is not restricted to this. The frequency can be adequately selected in consideration of the cleaning performance, the cost of the power source, etc.

The drum cleaner 36 in which the potential differences among the rolls are set as described above operates in the following manner.

Since the first cleaning roll 365A is always 0 V or higher although the AC voltage is applied to the roll, the first cleaning roll electrostatically attracts a minus-charged toner on the photosensitive drum 31 (removes the toner from the surface of the photosensitive drum 31), and holds the toner in the fiber layer 365*a*.

At this timing, in the first collection roll 366A which collects a toner from the first cleaning roll 365A, the potential difference of −25 V is always set with respect to the first cleaning roll 365A. This potential difference causes the first cleaning roll 365A to always hold a predetermined amount of toner, and the first collection roll 366A collects the excess amount of toner. The function relating to the holding of the predetermined amount of toner will be described later in detail.

The toner which is collected from the first cleaning roll 365A by the first collection roll 366A is scraped off from the surface of the first collection roll 366A by the first scraper 367A.

By contrast, the second cleaning roll 365B attracts and holds both a plus-charged toner which is not removed by the first cleaning roll 365A, and a minus-charged toner which is not removed by the first cleaning roll 365A. Namely, the peak-to-peak voltage of AC 400 V and DC +0 V is applied to the second cleaning roll 365B, and therefore the roll alternatingly repeats plus and minus potentials. When the roll has the minus potential, the roll attracts and holds the plus-charged toner, and, when the roll has the plus potential, the roll attracts and holds the minus-charged toner.

The peak-to-peak voltage of AC 400 V and DC −300 V is applied to the second collection roll 366B. Therefore, the roll always has a minus potential, and a potential difference of −300 V is always produced with respect to the second cleaning roll 365B. Therefore, the second collection roll 366B collects a substantially whole amount of the plus-charged toner held by the second cleaning roll 365B. The toner collected by the second collection roll 366B is scraped off from the surface of the second collection roll 366B by the second scraper 367B.

The minus-charged toner held by the second cleaning roll 365B is collected by the first collection roll 366A. Namely, the first collection roll 366A always has a potential difference of +175 V with respect to the second cleaning roll 365B, and, because of this potential difference, can collect the minus-charged toner held by the second cleaning roll 365B.

Namely, the first collection roll 366A which is disposed in contact with not only the first cleaning roll 365A but also the second cleaning roll 365B collects the minus-charged toner which is not collected by the second collection roll 366B, from the second cleaning roll 365B. Therefore, the whole amount of the toner is collected from the second cleaning roll 365B, and the phenomenon that a toner is accumulated on the second cleaning roll 365B to cause a cleaning failure does not occur.

As described above, the second cleaning roll 365B can collect both the plus- and minus-charged toners from the photosensitive drum 31. Even when the toner held by the first cleaning roll 365A is suddenly discharged toward the photosensitive drum 31 and plus- and minus-charged toners mixedly exist in the discharged toner, therefore, all of the toners can be removed. In the case where a configuration in which the second cleaning roll 365B removes only the plus-charged toner is employed, the minus-charged toner cannot be removed, and the toner remains to cause a point-like image defect in a formed image. According to the configuration, this phenomenon does not occur.

Next, the operations of holding a predetermined mount of toner by the first cleaning roll 365A, collecting the toner from the first cleaning roll 365A by the first collection roll 366A, and removing discharge products and the like from the photosensitive drum 31 by the first cleaning roll 365A will be described in detail.

As described above, the first cleaning roll 365A electrostatically attracts the minus-charged toner on the photosensitive drum 31, and holds the toner into the fiber layer 365*a*. On the other hand, in the first collection roll 366A, the potential difference of −25 V is always set with respect to the first cleaning roll 365A.

When the amount of the toner which is held in the fiber layer 365*a* by the first cleaning roll 365A is small, therefore, the state where the potential of the first collection roll 366A is lower than that of the outermost surface layer of the first cleaning roll 365A is maintained. Consequently, the toner held in the fiber layer 365*a* of the first cleaning roll 365A is not collected by the first collection roll 366A, and remains to be held in the fiber layer 365*a*.

When the amount of the toner held in the fiber layer 365*a* is increased to exceed a predetermined amount, however, the minus-charged toner causes the potential of the surface of the first cleaning roll 365A to be lowered. As a result, a state where the potential of the first collection roll 366A is higher than that of the outermost surface layer of the first cleaning roll 365A is formed. When this state is attained, there occurs a phenomenon that the toner held in the fiber layer 365*a* of the first cleaning roll 365A begins to be transferred to the first collection roll 366A and is collected by the first collection roll 366A.

When a predetermined amount of toner is transferred from the first cleaning roll 365A to the first collection roll 366A, the state where the potential of the first collection roll 366A is lower than that of the outermost surface layer of the first cleaning roll 365A is again formed, and the toner transfer to the first collection roll 366A is stopped.

When the bias voltage to be applied to the first collection roll 366A is set to be lower than that to be applied to the first cleaning roll 365A in this way, the state where the predetermined amount of toner is always held in the fiber layer 365*a* of the first cleaning roll 365A can be maintained. Namely, the held amount of toner in the fiber layer 365*a* can be adequately adjusted by adjusting the voltage difference between the bias voltage to be applied to the first collection roll 366A and that to be applied to the first cleaning roll 365A.

The toner held in the peripheral surface (the fiber layer 365*a*) by the first cleaning roll 365A has a function of removing filming, discharge products, and the like formed on the surface of the photosensitive drum 31.

Filming causes the following phenomenon. The components of the surface (photosensitive member) of the photosensitive drum 31 which are shaved off by the mechanical sliding contact force of the cleaning member (the first cleaning rolls 365A, 365B in the exemplary embodiment) are again fixed to the surface of the photosensitive drum 31, thereby producing spot-like or raindrop-like attached regions in the surface of the photosensitive drum 31. As a result, an image defect such as a spot-like or raindrop-like void is produced in a formed image.

Discharge products are produced by a discharge caused when, in the image-forming cycle, the photosensitive drum 31 is charged by the charger 32. In a machine in which the process speed is high, such as a high-speed machine or a color copying machine, discharge products are produced in a large amount. When such discharge products adhere to the surface of the photosensitive drum 31, the resistance is lowered particularly under a high-temperature and high pressure environment (for example, temperature: 28° C., humidity: 85%). This causes charges in the surface of the photosensitive drum 31 to leak, whereby the contrast of the latent image potential is lowered and a void portion is produced in an image.

When the sliding contact force is enhanced, discharge products can be removed also by a usual elastic or brush roll, or the like. In this case, however, the photosensitive member is shaved and the above-mentioned filming is caused. Furthermore, the life period of the photosensitive drum 31 is shortened.

In the drum cleaner 36 in the exemplary embodiment, the fiber layer 365*a* of the first cleaning roll 365A holds a toner, and the fiber layer 365*a* in a state where the toner is held is in sliding contact with the surface of the photosensitive drum 31. Therefore, the toner held by the fiber layer 365*a* removes discharge products and the like adhering to the surface of the photosensitive drum 31. This is based on the finding obtained from experiments conducted by the inventors. The mechanism of the removal is not thoroughly known. However, it is presumed that the binder resin component constituting the toner, such as polyethylene or polystyrene adsorbs discharge products and the like.

Next, the relationship between the potential difference between the first cleaning roll 365A and the first collection roll 366A, and the amount of toner held in the fiber layer 365*a* of the first cleaning roll 365A will be described.

Figure 8:
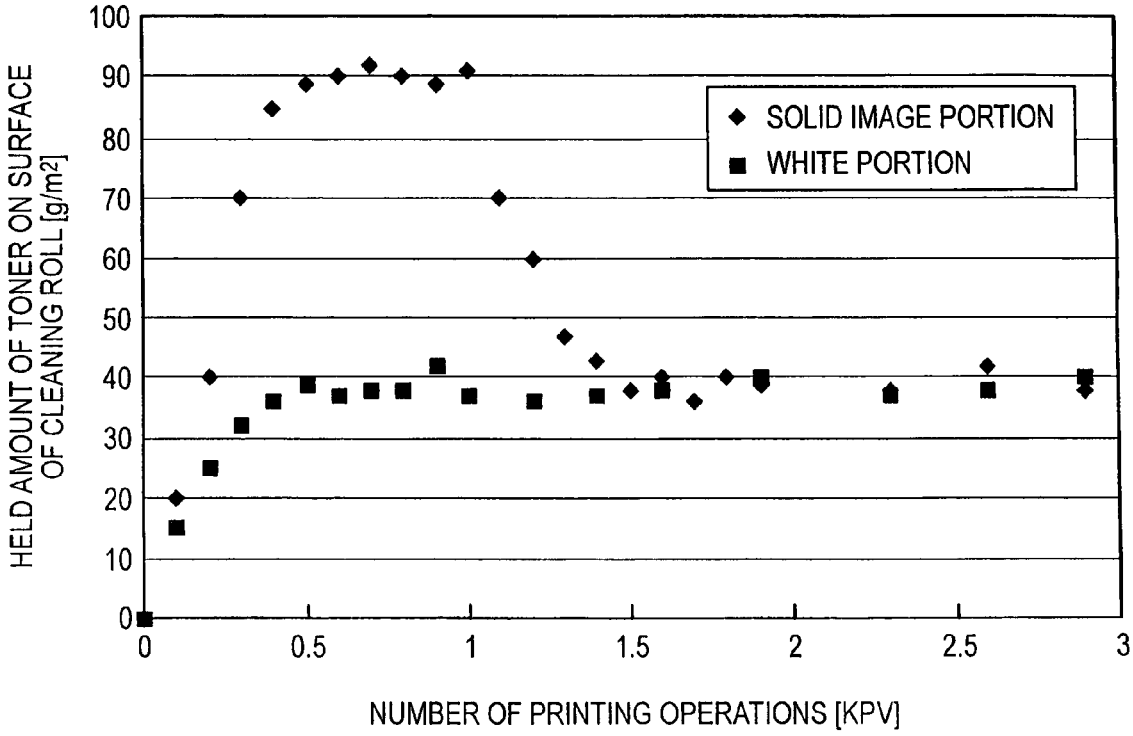
FIG. 8 is a view shows results of measurements of an amount of toner which is held in a fiber layer of the first cleaning roll.
Figure 9:
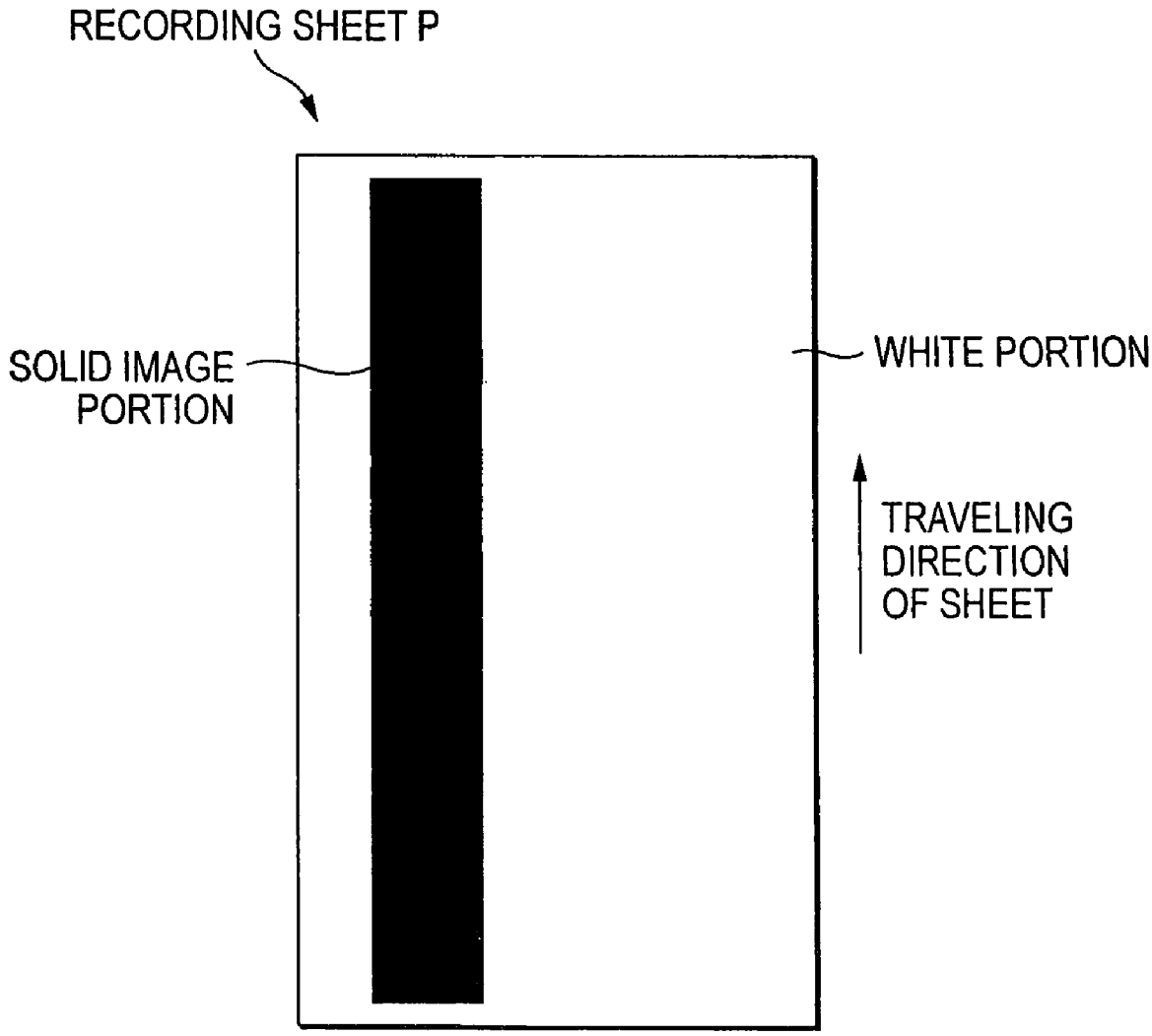
FIG. 9 is a view showing a chart used in an experiment.

FIG. 8 shows results of measurements of an amount (a weight per unit area: $g/m^2$) of a toner which is held in the fiber layer 365*a* of the first cleaning roll 365A while setting the bias voltage to the first cleaning roll 365A to DC +300 V, and that to the first collection roll 366A to DC +275 V (the potential difference is −25 V). FIG. 9 shows a chart used in the experiment.

In the experiment of FIG. 8, 1,000 strip charts in which a strip-like solid image portion of a predetermined width is formed in the traveling direction of the recording sheet P shown in FIG. 9 are continuously subjected to a printing operation (1 KPV), and then 2,000 complete-white (solid) charts are continuously subjected to a printing operation (2 KPV).

When such a strip chart is subjected to a printing operation, in the region of the photosensitive drum 31 corresponding to the solid image portion of the strip chart, a toner of 0.5 $g/m^2$ is attached as a post-transfer residual toner. In the case of a white chart, a toner of 0.01 to 0.02 $g/m^2$ is attached as a post-transfer residual toner.

As a result, as shown in FIG. 8, when 1,000 strip charts are continuously subjected to a printing operation, a toner of 0.5 $g/m^2$ is supplied to a region of the fiber layer 365*a* corresponding to the solid image portion. Therefore, the held amount of toner is saturated to about 90 $g/m^2$ at the timing of about 500 printing operations. The state is maintained until 1,000 printing operations. At the timing of 1,000 printing operations, the strip charts are switched to the white charts, and a toner of 0.01 to 0.02 $g/m^2$ is supplied. Therefore, the toner held in the region of the fiber layer 365*a* corresponding to the solid image portion is gradually collected by the first collection roll 366A, and then the amount is saturated to about 40 $g/m^2$.

In a region of the fiber layer 365*a* corresponding to the portion other than the solid image portion, a toner of 0.01 to 0.02 $g/m^2$ is supplied in both the printing operations on the strip charts and the white charts. Therefore, the held amount of toner is saturated to about 40 $g/m^2$ at the timing of about 500 printing operations. The state is maintained until 3,000 printing operations.

As apparent from the result of FIG. 8, when the bias voltage to the first cleaning roll 365A is set to +300 V and that to the first collection roll 366A is set to +275 V, the held amount of toner in the region of the fiber layer 365*a* to which a toner of 0.5 $g/m^2$ for the solid image portion is supplied is maintained to about 90 $g/m^2$, and that in the region of the fiber layer 365*a* to which a toner of 0.01 to 0.02 $g/m^2$ for the white region is supplied is maintained to about 40 $g/m^2$. In this voltage setting, therefore, the held amount of toner in the fiber layer 365*a* is maintained between the lower limit of 40 $g/m^2$ and the upper limit of 90 $g/m^2$.

FIG. 10 is a view for evaluating the relationships between, in the drum cleaner 36 of the exemplary embodiment in which a predetermined amount of toner is always held, the held amount (g/m$^2$) of toner held in the fiber layer 365*a* of the first cleaning roll 365A and the occurrence or non-occurrence of image deletion due to discharge products of the surface of the photosensitive drum 31, those between the held amount and the occurrence or non-occurrence of filming due to scratches or the like of the surface of the photosensitive drum 31, and those between the held amount and the toner cleaning performance.

The evaluation of FIG. 10 is performed by evaluating a first image obtained after 10,000 printing operations and subsequent non-operation during the day and night (about 24 hours). Discharge products adhering to the surface of the photosensitive drum 31 gradually adsorb moisture to lower the resistance of the photosensitive layer. As the resistance is lower, a void due to image deletion occurs more easily. Therefore, a print image obtained after non-operation during the day and night is evaluated. The occurrence or non-occurrence of filming is determined by observing the surface of the photosensitive drum 31 under a microscope. The cleaning performance is evaluated by observing the surface of the photosensitive drum 31 after the drum passes through the drum cleaner 36.

From the result, it is noted that image deletion occurs in the range where the held amount of toner is 20 g/m$^2$ or less, and dose not occur in the range where the held amount of toner is 30 g/m$^2$ or more. Therefore, it is found that, when the fiber layer 365*a* holds a toner of 30 g/m$^2$ or more, discharge products adhering to the surface of the photosensitive drum 31 can be removed from the photosensitive drum 31 to a degree where occurrence of image deletion is suppressed.

In this case, as a result of observation of the surface of the photosensitive drum 31 under a microscope, it is confirmed that filming does not occur in any range of the held amount of toner. It seems that this is based on that the sliding contact force of the first cleaning roll 365A against the surface of the photosensitive drum 31 is set to be low, and that the toner removes a filming material.

By contrast, in the range where the held amount of toner exceeds 150 g/m$^2$, the toner collection ability of the fiber layer 365*a* is lowered, and hence the cleaning performance is not sufficiently exerted.

From the evaluation results of FIG. 10, in order to remove discharge products to suppress occurrences of image deletion and filming, and ensure the cleaning performance with respect to a toner, it is preferable that the amount of toner held by the fiber layer 365*a* is 30 to 150 g/m$^2$ or about 30 to about 150 g/m$^2$.

From other experiments, however, a result that, when the photosensitive drum 31 is rotated for a predetermined time period (for example, 5 minutes) in a state where a toner is always held by the fiber layer 365*a*, occurrence of image deletion can be suppressed even in the case where the held amount of toner is 20 g/m$^2$ is obtained. When assuming that such an operation is performed in a cycle before or after image formation, therefore, it is also possible that the amount of toner to be held by the fiber layer 365*a* is set to 20 to 150 g/m$^2$ or about 20 to about 150 g/m$^2$.

Next, voltage relationships to be set between the first cleaning roll 365A and the first collection roll 366A in order to set the amount of toner held by the fiber layer 365*a* to 20 to 150 g/m$^2$ will be described.

Figure 11:
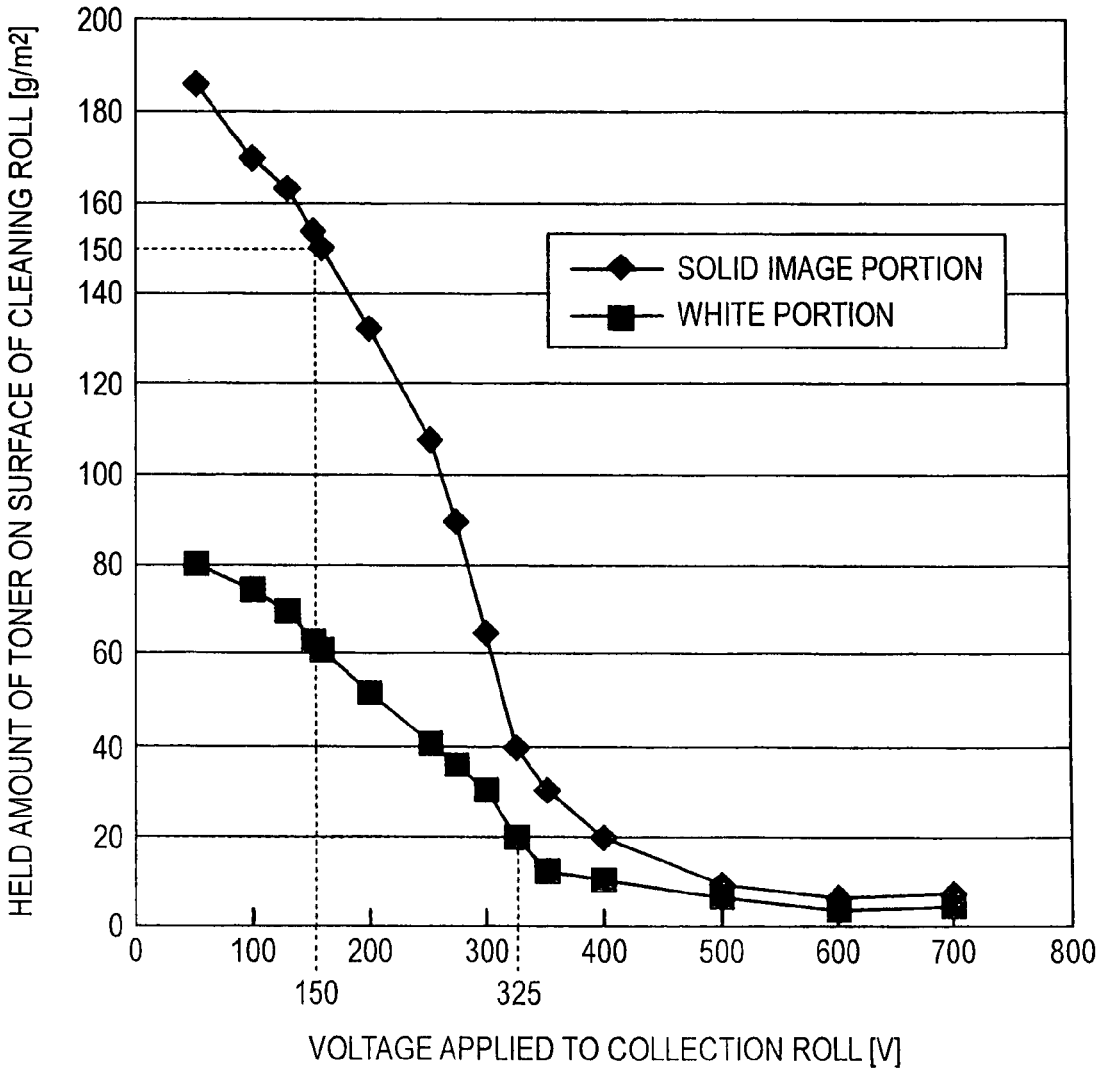
FIG. 11 is a view showing results of measurements in which the amount of toner held by the fiber layer is measured in the case where a bias voltage supplied to the first cleaning roll and that supplied to the first collection roll are changed.

FIG. 11 is a view showing results of measurements in which the amount of toner held by the fiber layer 365*a* is measured in the case where the bias voltage supplied to the first cleaning roll 365A is fixed to +300 V and that supplied to the first collection roll 366A is changed.

From the results shown in FIG. 11, in order to set the held amount of toner to 20 g/m$^2$ or more also in a white potion, the upper limit of the bias voltage supplied to the first collection roll 366A is +325 V.

In order to set the held amount of toner to 150 g/m$^2$ or less also in a solid image potion, the lower limit of the bias voltage supplied to the first collection roll 366A is +150 V. When the bias voltage supplied to the first collection roll 366A is +300 V, therefore, it is preferable that the bias voltage supplied to the first collection roll 366A is +150 to +325 V.

From the above, in order to set the amount of toner held by the fiber layer 365*a* to 20 to 150 g/m$^2$, the difference between the voltage of the first cleaning roll 365A and that of the first collection roll 366A (=voltage of first cleaning roll 365A−voltage of first collection roll 366A) is required to be set to −25 to 150 V. Including also the case where a positive toner is used and a minus bias voltage is applied to the first cleaning roll 365A and the first collection roll 366A, usually, it is required to set the difference between the absolute value of the voltage of the first cleaning roll 365A and that of the first collection roll 366A (=|voltage of first cleaning roll 365A|−|voltage of first collection roll 366A|) to −25 to 150 V.

In the color printer 1 of the exemplary embodiment, as shown in FIG. 10 described above, even in the case of a white chart, about 500 printing operations cause the amount of toner held by the fiber layer 365*a* to be about 40 g/m$^2$. Also in initial installation of the color printer 1, when a normal method of use is conducted, therefore, there occur fewer problems about removal of discharge products. Assuming a method of use in which sufficient removal of discharge products must be performed also in initial installation (for example, between 0 to 500 printing operations) of the color printer 1, however, also setting of a toner supply mode is effective. According to the toner supply mode, in initial installation of the color printer 1, in each of the image-forming units 30, a strip-like solid image of a width of 3 cm is formed in, for example, the whole area in the width direction of the photosensitive drum 31, the operation of the primary transfer roll 42 is turned off to disable the transferring process in the primary transferring portion T1, and all of the toner is supplied to the first cleaning roll 365A. According to the configuration, even in the initial printing operation, it is possible to set the amount of toner held by the fiber layer 365*a* to about 40 g/m$^2$. In the above, the operation of the primary transfer roll 42 is turned off, and a large amount of the developing agent is supplied to the first cleaning roll 365A. However, the countermeasure may be suitably set in accordance with the system. For example, the operation of the primary transfer roll 42 is not completely turned off, and the transfer electric field is weakened, thereby increasing the amount of post-transfer residual toner in accordance with the transfer efficiency, or the like.

The toner supply mode is not restricted to the initial installation of the color printer 1. For example, the mode may be performed for each time when a predetermined number of printing operations such as 500 printing operations are performed. According to the configuration, even when an image in which the image density is uneven is continuously printed, the held amount of toner can be uniformalized over the whole range in the axial direction of the first cleaning roll 365A.

The timing of implementing the toner supply mode may be before or after the image-forming cycle, or between the image-forming cycles.

In this case, the toner supply mode is set by the controlling portion 60, and the controlling portion 60 functions as a toner supply mode setting portion.

In the thus configured color printer 1 of the exemplary embodiment, a toner can be satisfactorily removed from the photosensitive drum 31. Furthermore, a predetermined amount of toner is held by the fiber layer 365*a* of the first cleaning roll 365A, so that adhering discharge products can be removed without causing abrasion or scratches in the photosensitive drum 31. Therefore, image deletion and voids due to discharge products can be suppressed. Moreover, abrasion of the photosensitive member of the photosensitive drum 31 can be suppressed. Therefore, it is possible to prevent filming from occurring. Even when filming occurs, the filming can be removed, and an image defect can be prevented from being produced.

The color printer 1 having this configuration is subjected to a sheet passing test of 30,000 sheets. Voids due to discharge products, voids due to filming, and cleaning failure are not caused until the last passing. Also a point-like image defect is not caused. As a result, the effectiveness of the configuration is confirmed.

The first cleaning roll 365A used in the test is a conductive nylon cloth roll in which the fiber layer 365*a* is formed by winding a sheet of about 90 μm configured by knitting conductive nylon of 0.5 d (deniers) on a sponge roll having a shaft diameter of ϕ6 mm, and the outer diameter is ϕ12 mm.

The second cleaning roll 365B is the above-described conductive nylon brush.

In the sheet passing test, various parameters of image formation are as follows.

Photosensitive drum (photosensitive drum 31)
OPC, ϕ84 mm
Charger (charger 32)
Scorotron −945 μA, grid voltage: 620 V
Exposing device (laser exposing device 26)
Laser: 780 nm
Intermediate transfer member (intermediate transfer belt 41)
Polyimide
Process speed
420 mm/s
Latent image potential
Background portion: −600 V
Image portion: −300 V
Developer (developer 33)
Developing system: two-component developing system
Diameter of developing roll sleeve: ϕ16 mm
Rotation speed of sleeve: 800 mm/s
Gap between photosensitive member and developing roll: 0.3 mm
Development bias
DC component: −500 V
AC component: 1.5 kVP-P (6 kHz)
Transfer conditions
Primary transfer roll: +40 μA
Secondary transfer roll: +1600 V As described above, in the color printer 1 of the exemplary embodiment, the drum cleaner 36 can remove toners charged to both the polarities from the surface of the photosensitive drum 31, and a toner is held by the first cleaning roll 365A including the fiber layer 365*a* made of conductive fibers in the surface, whereby discharge products and the like can be effectively cleaned away from the surface of the photosensitive drum 31. Therefore, stable and excellent image formation can be performed for a long term.

The invention is not restricted to the exemplary embodiment, and may be adequately modified.

In the exemplary embodiment, for example, the first cleaning roll 365A in which the fiber layer 365*a* made of conductive fibers is provided in the surface layer to hold a toner is placed on the upstream side in the rotation direction of the photosensitive drum 31, and the second cleaning roll 365B which collects a toner is placed on the downstream side. Alternatively, the cleaning rolls 365A, 365B may be placed while inverting the upstream and downstream relationship therebetween.

The cleaning device of the invention is not restricted to a cleaning device for cleaning a photosensitive drum. For example, the invention may be used in a cleaning device (the belt cleaner 50 of FIG. 1 in the exemplary embodiment) for cleaning an intermediate transfer belt, etc.

Figure 12:
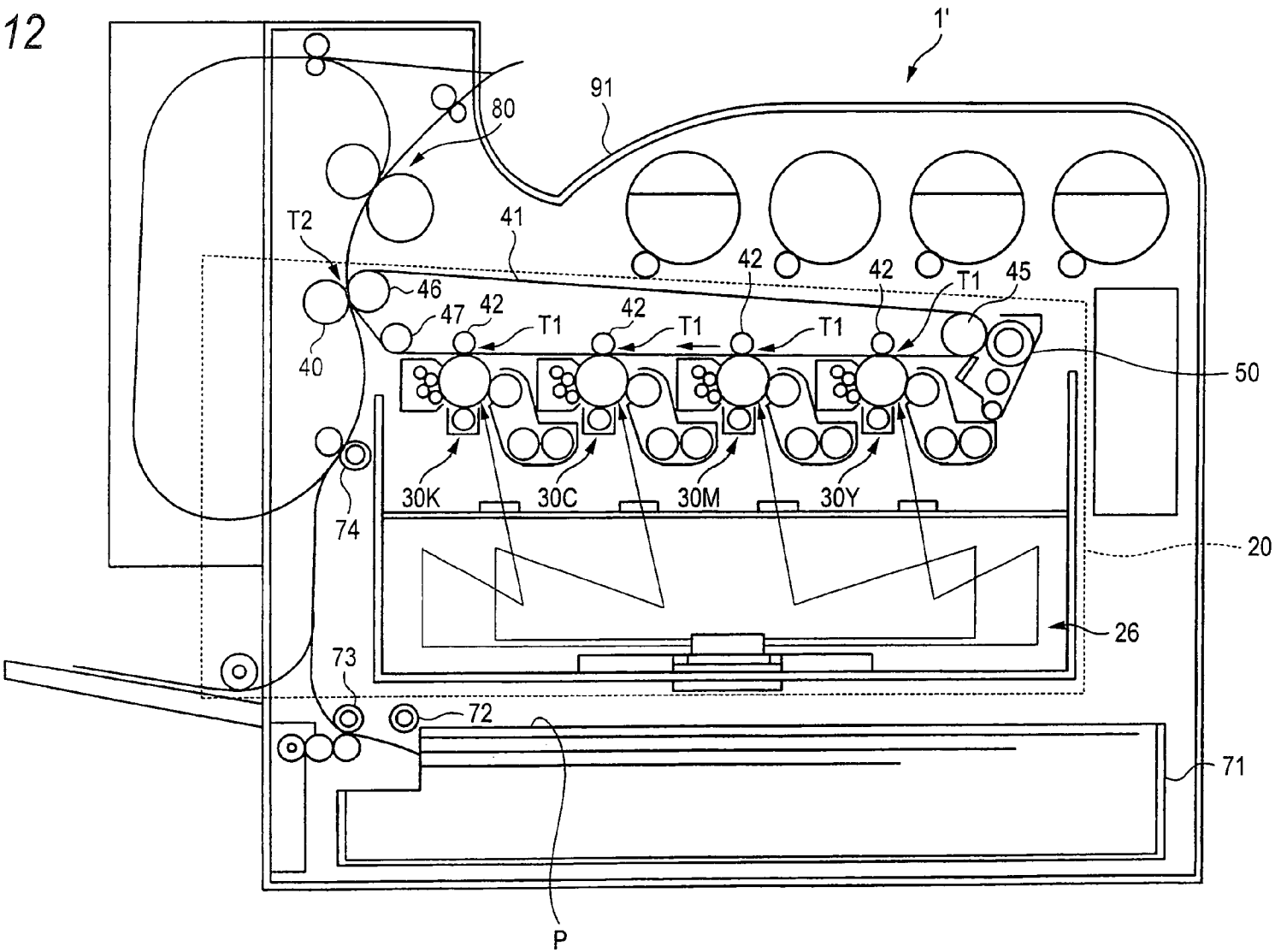
FIG. 12 is a view showing the configuration of another color printer, wherein 1 denotes Color Printer (Image-forming Apparatus), 31 denotes Photosensitive Drum (Image Carrier), 33 denotes Developer (Developing Portion), 36 denotes Drum Cleaner (Cleaning Device, Toner Removing Portion), 365A denotes First Cleaning Roll (First Cleaning Member), 365B denotes Second Cleaning Roll (Second Cleaning Member), 365*a* denotes Fiber Layer (Surface Layer), 365*b* denotes Elastic Layer, 366A denotes First Collection roll (First Collection member), 366B denotes Second Collection roll (Second Collection member), 41 denotes Intermediate Transfer Belt (Transfer Member), 42 denotes Primary Transfer Roll (Transferring Portion), 60 denotes Controlling Portion (Controlling Unit), 65 denotes Power Source Portion, 651A denotes First Cleaning Roll Bias Power Source, 651B denotes Second Cleaning Roll Bias Power Source, 652A denotes First Collection roll Bias Power Source, and 652B denotes Second Collection roll Bias Power Source.

The color printer may have a configuration shown as a color printer 1' in FIG. 12. The reference numerals in the figure are used in common with the color printer 1 shown in FIG. 1.

The color printer 1' has a configuration in which the image-forming units 30 (30Y, 30M, 30C, 30K) are placed under the intermediate transfer belt 41, and the laser exposing device 26 is placed under the image-forming units. The intermediate transfer belt 41 circulates in a clockwise direction in the figure, and is configured so that a toner image held by the intermediate transfer belt 41 is transferred to the recording sheet P in the secondary transferring portion T2 which is on the left side of the circulating path in the figure. According to the configuration, the moving distance of the intermediate transfer belt 41 carrying a toner image, between the primary transferring portion T1 in which a toner image is transferred from the image-forming units 30 to the intermediate transfer belt 41, and the secondary transferring portion T2 in which a toner image is transferred from the intermediate transfer belt 41 to the recording sheet P can be set to be short.

It is a matter of course that the configuration of the invention may be applied to a monochrome image-forming apparatus.

The configuration and effects of the exemplary embodiment of the invention are as follows.

(1) The cleaning rolls 365A, 365B are set to be longer than the charge width of the photosensitive drum 31, the collection rolls 366A, 366B are set to be longer than the cleaning rolls 365A, 365B, and the scrapers 367A, 367B are set to be longer than the collection rolls 366A, 366B. Therefore, the photosensitive drum can be surely cleaned, and the removed toner and the like can be surely discharged.

(2) In the collection rolls 366A, 366B, the first collection roll 366A is set so as not to be positioned under the position where the scraper 367B removes a toner and the like from the second collection roll 366B situated on the upper side. Therefore, a phenomenon that the toner and the like removed by the scraper 367B from the second collection roll 366B fall on the first collection roll 366A situated on the lower side to cause a problem does not occur.

(3) In the first cleaning roll 365A, the fiber layer 365*a* made of soft conductive fibers is placed in the surface, and the elastic layer 365 is formed under the fiber layer 365*a*. Therefore, the roll can be in contact also with the first collection roll 366A with high contactness and at a low pressure. Consequently, scratches are hardly formed also in the surfaces of the collection rolls 366A, 366B, and a toner collection failure due to such scratches can be prevented from occurring.

(4) In the first cleaning roll 365A, a sliding contact force at which discharge products can be removed by the effect of a toner can be set. Therefore, there is a low possibility that shaved components of the photosensitive drum 31 are fixed to the surface of the photosensitive drum 31 to cause filming. Moreover, not only discharge products, but also shaved components of the photosensitive drum 31, and the like are adsorbed and removed by a toner. Therefore, the possibility that filming is caused is low.

What is claimed is:

1. A cleaning device comprising:

a first cleaning member that includes a surface layer formed by a cloth made of conductive fibers, contacts an image carrier holding an image and cleans the image carrier with a predetermined voltage applied to the first cleaning member;

wherein the first cleaning member rotates in the opposite direction from the image carrier;

a second cleaning member that contacts the image carrier and cleans the image carrier with a predetermined voltage applied to the second cleaning member;

a first collection member that contacts the first and second cleaning members and collects adhering substances from the first and second cleaning member with a predetermined voltage applied to the first collection member; and a second collection member that contacts the second cleaning member and collects adhering substances from the second cleaning member with a predetermined voltage applied to the second collection member, wherein the cloth forming the surface layer of the first cleaning member and made of the conductive fibers is selected from the group consisting of a cloth into which the conductive fibers are knitted, a cloth into which the conductive fibers are woven and a nonwoven cloth which is made of the conductive fibers.

2. The cleaning device according to claim 1, wherein the first cleaning member includes a conductive elastic layer below the surface layer.

3. An image carrier unit comprising:

an image carrier that carries a toner; and the cleaning device according to claim 1.

4. The cleaning device of claim 1, wherein the first collection member rotates in the opposite direction from the image carrier.

5. The cleaning device according to claim 1, wherein the predetermined voltage applied to the first cleaning member is an AC voltage that has a first polarity based on a voltage of the image carrier and oscillates, the predetermined voltage applied to the second cleaning member is an AC voltage that has the first polarity and a second polarity, which is opposite to the first polarity based on the voltage of the image carrier and oscillates, the predetermined voltage applied to the first collection member is a voltage that has the first polarity with respect to the AC voltage applied to the second cleaning member, and the predetermined voltage applied to the second collection member is a voltage that has the second polarity with respect to the AC voltage applied to the second cleaning member.

6. A cleaning device comprising:

a first cleaning member that includes a surface layer formed by a cloth made of conductive fibers, contacts an image carrier holding an image and cleans the image carrier with a predetermined voltage applied to the first cleaning member;

wherein the first cleaning member rotates in the opposite direction from the image carrier;

a second cleaning member that contacts the image carrier and cleans the image carrier with a predetermined voltage applied to the second cleaning member;

a first collection member that contacts the first and second cleaning members and collects adhering substances from the first and second cleaning member with a predetermined voltage applied to the first collection member; and a second collection member that contacts the second cleaning member and collects adhering substances from the second cleaning member with a predetermined voltage applied to the second collection member, wherein each of the predetermined voltages applied to the first and second cleaning members and the first and second collection members contains at least an in-phase AC voltage; and the cloth forming the surface layer of the first cleaning member and made of the conductive fibers is selected from the group consisting of a cloth into which the conductive fibers are knitted, a cloth into which the conductive fibers are woven and a nonwoven cloth which is made of the conductive fibers.

7. The cleaning device according to claim 6, wherein the predetermined voltage applied to the second cleaning member is determined for the second cleaning member to remove both positively charged adhering substances and negatively charged adhering substances on the image carrier.

8. The cleaning device of claim 6, wherein the first collection member rotates in the opposite direction from the image carrier.

9. An image-forming apparatus comprising:

an image carrier that holds an image;

a developing portion that develops the image on the image carrier into a toner image;

a transferring portion that transfers the toner image held by the image carrier; and a cleaning portion that removes a toner which is not transferred by the transferring portion and remains on the image carrier, wherein the cleaning portion comprises:

a first cleaning member that includes a surface layer formed by a cloth made of conductive fibers, contacts the image carrier and removes the toner on the image carrier with a predetermined voltage applied to the first cleaning member;

wherein the first cleaning member rotates in the opposite direction from the image carrier;

a second cleaning member that contacts the image carrier and removes the toner on the image carrier with a predetermined voltage applied to the second cleaning member;

a first collection member that contacts the first and second cleaning members and collects the toner from the first and second cleaning member; and a second collection member that contacts the second cleaning member and collects the toner from the second cleaning member, wherein the cloth forming the surface layer of the first cleaning member and made of the conductive fibers is selected from the group consisting of a cloth into which the conductive fibers are knitted, a cloth into which the conductive fibers are woven and a nonwoven cloth which is made of the conductive fibers.

10. The image-forming apparatus according to claim 9, wherein, to each of the first and second collection members, a predetermined voltage containing at least an in-phase AC voltage is applied.

11. The image-forming apparatus according to claim 10, wherein each of the predetermined voltages applied to the first cleaning member and the first collection member is determined for the first cleaning member to hold a predetermined an-bunt of the toner on the surface layer with the toner removed from the image carrier.

12. The image-forming apparatus according to claim 11, wherein the predetermined amount of the toner held by the surface layer of the first cleaning member is from about 30 $g/m^2$ to about 150 $g/m^2$.

13. The image-forming apparatus according to claim 9, further comprising:

a controlling portion that controls an operation of at least one of the developing portion, the transferring portion and the cleaning portion, wherein the controlling portion has a toner supply control of supplying the toner onto the surface layer of the first cleaning member for the surface layer to hold the toner.

14. The image-forming apparatus according to claim 13, wherein an amount of the toner held by the surface layer of the first cleaning member is from about 20 $g/m^2$ to about 150 $g/m^2$, and the controlling portion rotates the image carrier in a state where the image carrier does not hold an image.

15. The image-forming apparatus according to claim 13, wherein the controlling portion sets the toner supply control during an image formation.

16. The image-forming apparatus according to claim 13, wherein the controlling portion sets the toner supply control not during an image formation.

17. The image-forming apparatus of claim 9, wherein the first collection member rotates in the opposite direction from the image carrier.

* * * * *